US011274423B2

(12) United States Patent
Gordon

(10) Patent No.: US 11,274,423 B2
(45) Date of Patent: Mar. 15, 2022

(54) ROAD GRADER BLADE TEETH REMOVAL APPARATUS

(71) Applicant: G. Dennis Gordon, Porquis Jct (CA)

(72) Inventor: G. Dennis Gordon, Porquis Jct (CA)

( * ) Notice: Subject to any disclaimer, the term of this patent is extended or adjusted under 35 U.S.C. 154(b) by 555 days.

(21) Appl. No.: 16/283,446

(22) Filed: Feb. 22, 2019

(65) Prior Publication Data

US 2020/0270849 A1 Aug. 27, 2020

(51) Int. Cl.
*E02F 9/28* (2006.01)
*E02F 3/80* (2006.01)
*B25B 27/04* (2006.01)

(52) U.S. Cl.
CPC ..... *E02F 9/2891* (2013.01); *B25B 27/04* (2013.01); *E02F 3/80* (2013.01); *E02F 9/28* (2013.01)

(58) Field of Classification Search
CPC ..... B25B 27/026; E02F 9/2891; E02F 3/76; E02F 3/8152; E21C 35/188
See application file for complete search history.

(56) References Cited

U.S. PATENT DOCUMENTS 1,922,917 A * 8/1933 Russell ..... E02F 9/285 172/701.3
1,986,493 A * 1/1935 John ..... B25B 27/04 59/7
4,574,611 A * 3/1986 Hegemann ..... B21D 5/02 72/389.3
4,782,686 A * 11/1988 Carson, Jr. ..... B21D 7/06 72/373
5,176,922 A * 1/1993 Balsano ..... A21C 11/006 100/237
5,337,656 A * 8/1994 Hollnagel ..... B30B 1/003 100/125
6,526,641 B1 * 3/2003 Latham ..... B25B 27/026 29/239
7,013,694 B1 * 3/2006 Sims ..... B21D 5/02 72/326
7,874,085 B1 * 1/2011 Winter ..... E02F 3/8157 37/270
7,891,084 B1 * 2/2011 Sollami ..... E02F 9/2891 29/760
7,996,972 B2 * 8/2011 Hu ..... B25B 27/064 29/252

(Continued)

*Primary Examiner* — Jacob J Cigna
*Assistant Examiner* — Michael W Hotchkiss
(74) *Attorney, Agent, or Firm* — Gulf Coast Intellectual Property Group

(57) ABSTRACT

A road grading blade teeth removal apparatus operable to provide removal of teeth from a road grader blade. The apparatus of the present invention includes a frame having an upper end and a lower end. The upper end of the frame has a pair of upper spring mounts secured thereto on opposing sides of the frame. The upper spring mounts have springs suspended downward therefrom and are operably coupled to a pair of lower spring mounts that are axially aligned with each of the upper springs mounts on opposing sides of the frame. A center force plate is secured intermediate the lower spring mounts and has a movement member superposed thereon. The movement member is further operably coupled to a cross member proximate the top of the frame and is configured to leverage thereagainst to move the center force plate downward. A pin assembly is located underneath the mounting plate.

20 Claims, 3 Drawing Sheets

(56) References Cited

U.S. PATENT DOCUMENTS

| | | | | |
|---|---|---|---|---|
| 8,099,847 | B2 * | 1/2012 | Hahn | E21C 35/19 29/252 |
| 8,181,322 | B2 * | 5/2012 | Lehnert | B25B 27/026 29/243 |
| 8,333,439 | B2 * | 12/2012 | Gibbins | E02F 9/2841 301/44.1 |
| 9,163,379 | B2 * | 10/2015 | Winter | C22C 38/04 |
| 9,193,019 | B2 * | 11/2015 | Wang | G02F 1/1303 |
| 10,100,499 | B2 * | 10/2018 | Hedley | E02F 9/2891 |
| 10,822,770 | B2 * | 11/2020 | Parzynski, Jr. | E02F 9/2858 |
| 10,988,916 | B2 * | 4/2021 | Paul | E02F 9/2891 |
| 2011/0154799 | A1 * | 6/2011 | Sevrette | B25B 27/22 59/2 |
| 2012/0222335 | A1 * | 9/2012 | Charlton | E02F 9/2891 37/452 |
| 2019/0316320 | A1 * | 10/2019 | Parzynski, Jr. | E02F 3/815 |

* cited by examiner

ROAD GRADER BLADE TEETH REMOVAL APPARATUS

FIELD OF THE INVENTION

The present invention relates generally to road construction equipment, more specifically but not by way of limitation, an apparatus configured to provide removal of individual teeth of a road grader blade, specifically a scarifier blade wherein the scarifier blade includes a plurality of individual replaceable teeth.

BACKGROUND

Road grading is well known in the art. Various equipment is utilized to perform road grading and this activity is typically performed utilizing heavy equipment. Road grading as is known in civil engineering is the process of ensuring a level base or a base having a specific desired slope. The base course for a road is also known as a sub-grade and essentially serves as the foundation for the road material that will be superposed thereon. The sub-grade level is the level of material that is immediately above the natural ground and forms the beginning of the layers that will ultimately comprise a road. The road grading is typically performed utilizing a process that includes the utilization of heavy equipment such as but not limited to bulldozers and excavators.

As is known in the art, scarifier blades are configured to penetrate hard-packed, frozen and gravel surfaces with less down pressure required as compared to planar grader blades. Scarifier blades utilize a blade that includes a plurality of replaceable teeth. The teeth of a conventional scarifier blade are manufactured from a material such as but not limited to carbide and are mounted in an axial alignment in specially designed teeth receptacles. As the blade is engaged with the road surface, the blade design facilitates the grading of the road with fewer passes than a conventional planar blade. The teeth of a scarifier blade are configured to be replaceable and are typically punched out of the teeth receptacles utilizing tools such as but not limited to a hammer or similar element. One of the problems that exist with replacing the teeth on a scarifier blade is that over time dirt and other debris builds up between the tooth blade and the tooth receptacle. As such removal of the tooth blade can be difficult and is not easily performed with hand tools.

Accordingly, there is a need for a road grading blade tooth removal apparatus that is configured to provide removal of individual teeth from a road grading blade such as but not limited to a scarifier blade.

SUMMARY OF THE INVENTION

It is the object of the present invention to provide an apparatus configured to provide removal of teeth from a road grading blade wherein the apparatus includes a frame having an upper portion and a lower portion.

Another object of the present invention is to provide an apparatus configured to provide teeth removal from a scarifier style of road grading blade wherein the upper portion of the frame is movable in an upwards-downwards direction.

A further object of the present invention is to provide an apparatus configured to provide removal of teeth from a road grading blade wherein the upper portion of the frame includes a hydraulic piston that is configured to provide the upwards-downwards movement of the upper portion of the frame.

Still another object of the present invention is to provide an apparatus configured to provide teeth removal from a scarifier style of road grading blade wherein the upper portion of the frame includes a mounting plate that is configured to support the hydraulic piston and further provide a support surface for a removal pin on the opposing side thereof.

An additional object of the present invention is to provide an apparatus configured to provide removal of teeth from a road grading blade wherein the mounting plate is movably secured utilizing springs that are configured to return the mounting plate to its first position.

Yet a further object of the present invention is to provide an apparatus configured to provide teeth removal from a scarifier style of road grading blade wherein the frame includes a lower portion having a pin support member configuration.

Another object of the present invention is to provide an apparatus configured to provide removal of teeth from a road grading blade wherein the lower portion of the frame of the present invention further includes a blade support member that is configured to provide support for the blade and provide proper positioning of the teeth for removal by the removal pin of the present invention.

Still another object of the present invention is to provide an apparatus configured to provide teeth removal from a scarifier style of road grading blade wherein the mounting plate of the upper portion of the frame further includes a pin mounting plate secured to the bottom surface thereof wherein the pin mounting plate has the removal pin secured thereto and extends downward therefrom.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
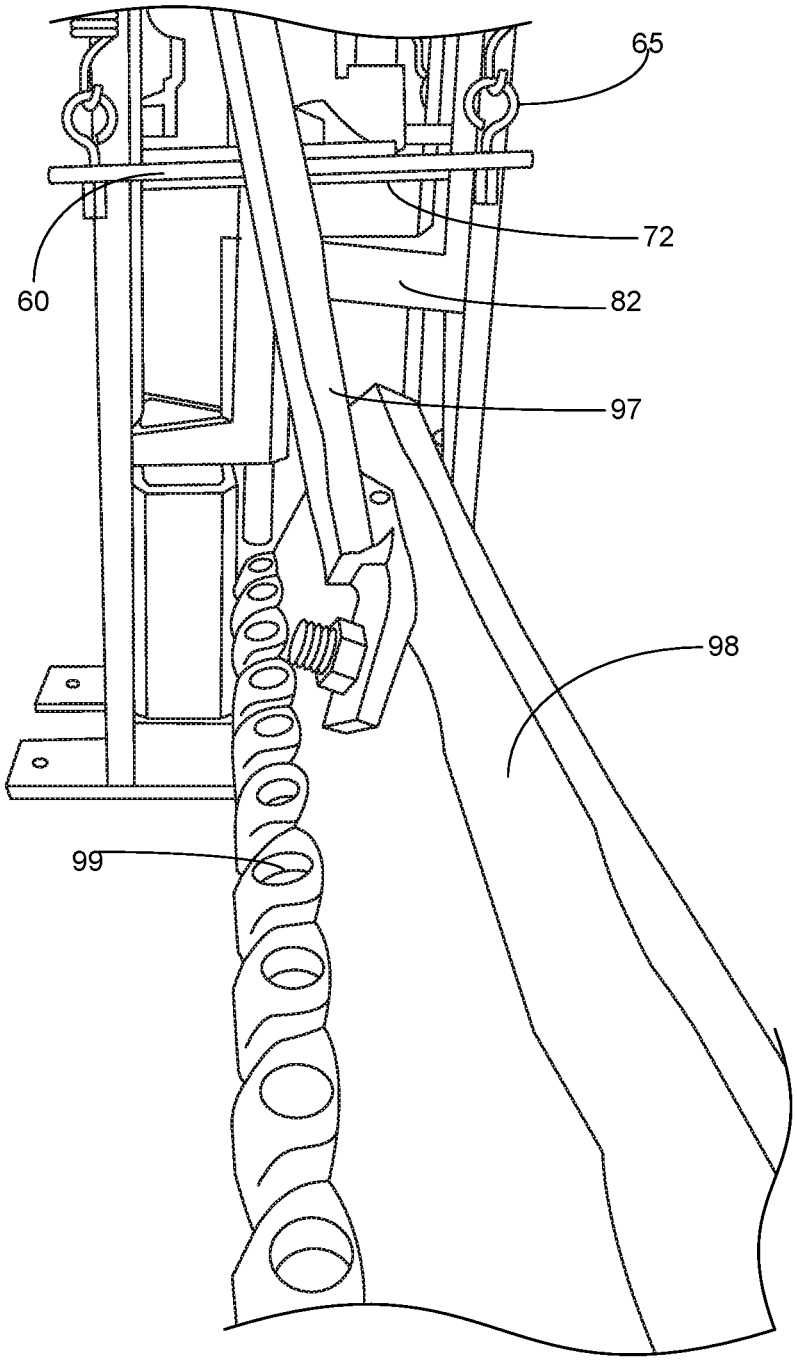
FIG. 1 is a detailed view of the present invention with a road grading blade engage therewith.
Figure 2:
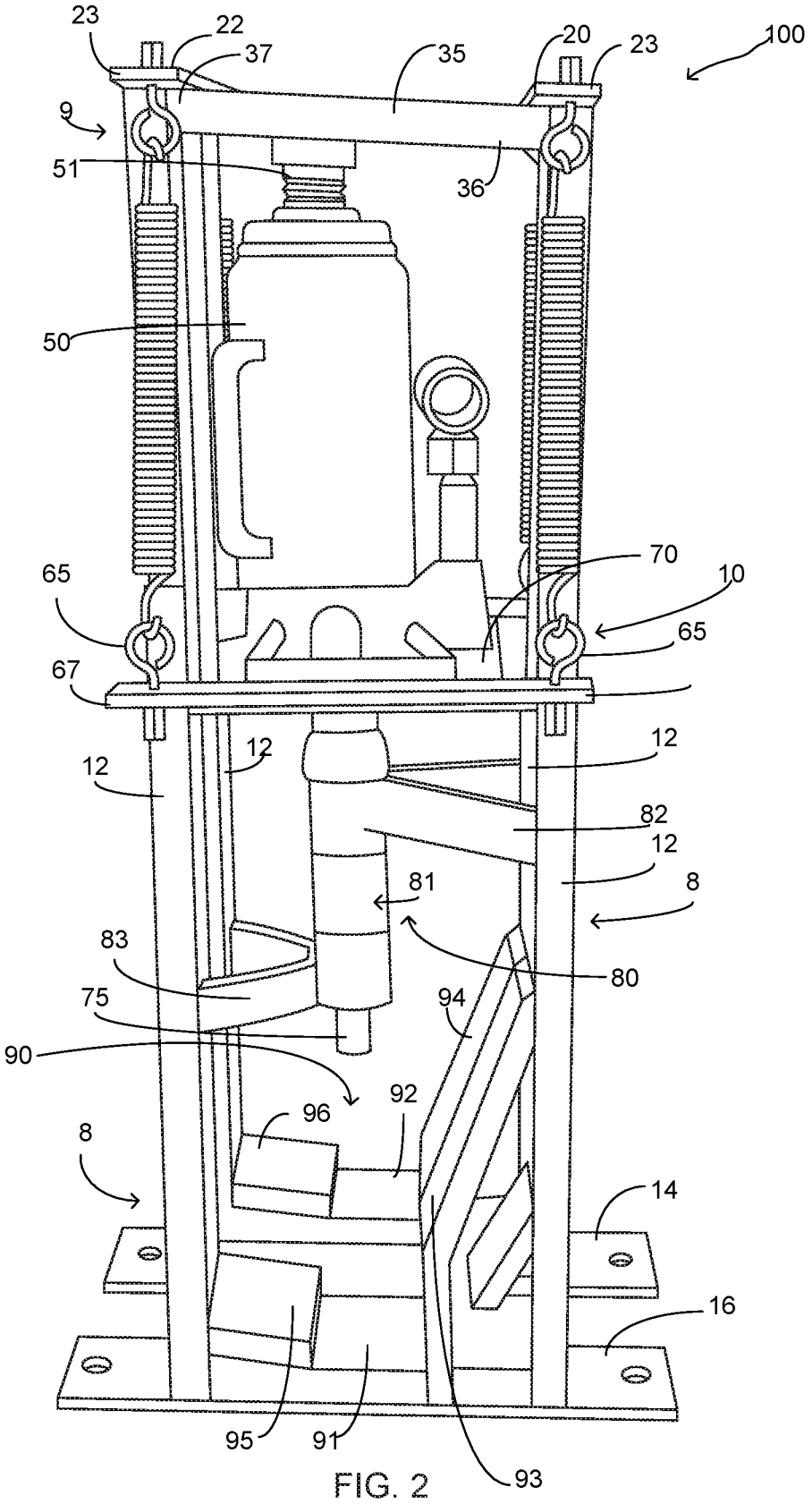
FIG. 2 is a front view of the present invention.
Figure 3:
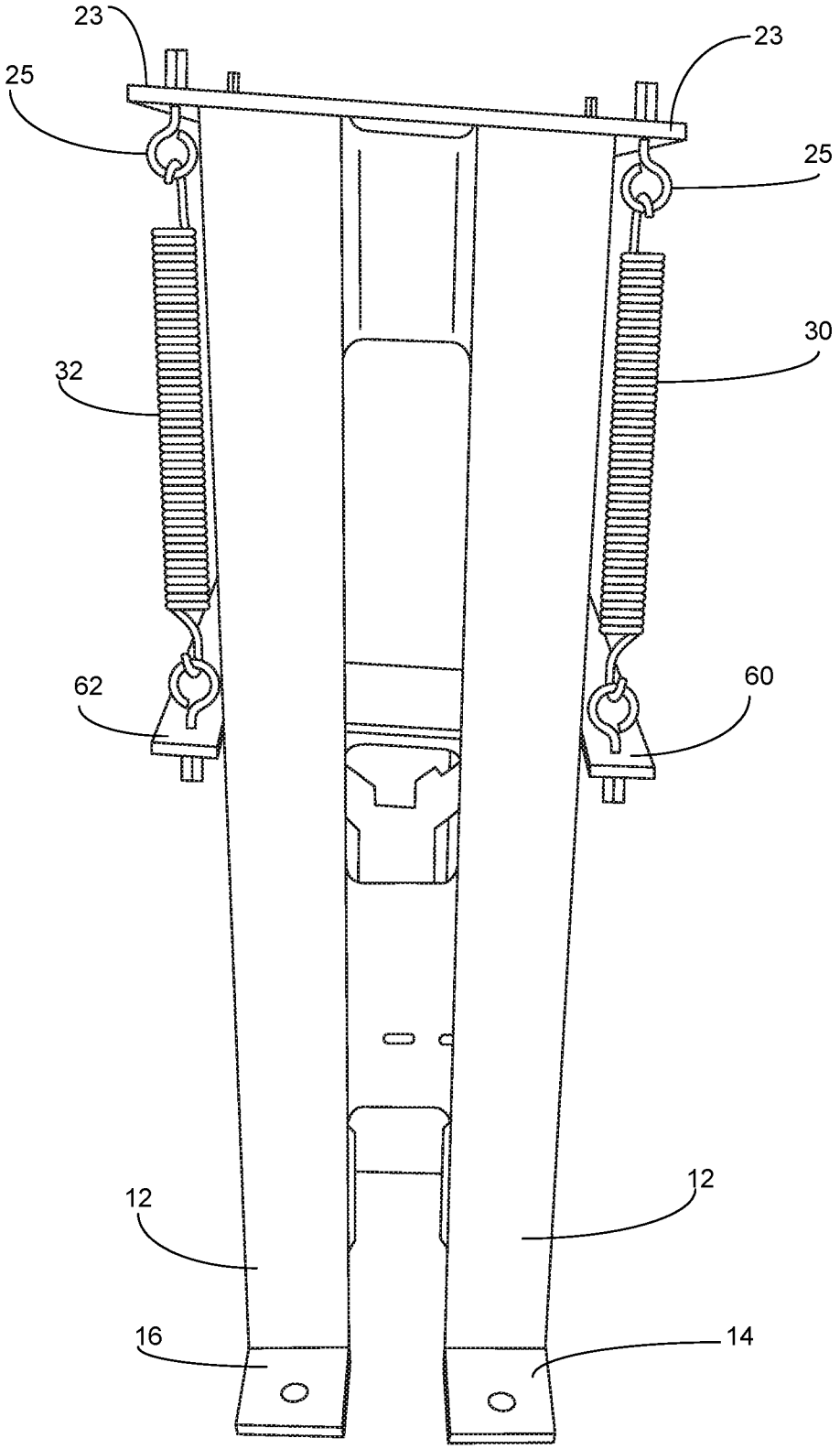
FIG. 3 is a side view of the present invention.

Referring now to the drawings submitted herewith, wherein various elements depicted therein are not necessarily drawn to scale and wherein through the views and figures like elements are referenced with identical reference numerals, there is illustrated a road grading blade teeth removal apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to Figures submitted as a part hereof, the road grading blade teeth removal apparatus 100 further includes a frame 10. The frame 10 includes four corner support members 12 wherein the four corner support members 12 define a square shape of the frame 10. The four corner support members 12 are superposed base plates 14, 16 and are perpendicular thereto. Base plates 14, 16 are configured to provide securing of the grading blade teeth removal apparatus 100 to a support support structure such as but not limited to a plate or mount. The four corner support members are manufactured from a rigid durable material such as but not limited to rectangular metal tubing. It should be understood within the scope of the present invention that the four corner support members 12 could be manufactured from suitable alternate materials. The frame 10 includes lower end 8 and upper end 9 wherein the base plates 14, 16 are located at the lower end 8 of the frame 10. While the frame 10 is illustrated herein as being constructed from four corner support members 12 superposed on base plates 14, 16, it is contemplated within the scope of the present invention that the frame 10 could be constructed in alternate manners and still achieved the desired objective as described herein. While not illustrated in particular herein, it is contemplated within the scope of the present invention that the top portion of the frame 10 and as such the four corner support members 12 are constructed so as to provide vertical adjustment in order to accommodate alternate sizes of the movement member 50.

The frame 10 further includes upper spring support members 20, 22. The upper spring support members 20, 22 are secured across the top of the four corner support members 12 wherein the upper spring support members 20, 22 are located on opposing sides of the frame 10 and are positioned so as to be parallel with respect to each other. The upper spring support members 20, 22 are secured to the top of the four corner support members 12 utilizing suitable durable techniques such as but not limited to welding. The upper spring support members 20, 22 are manufactured from a suitable rigid material such as but not limited to metal flat bar. The upper spring support members 20,22 include portions 23 that extend beyond each of the four corner support members 12. The portions 23 of the upper spring support members 20, 22 provide the required structure to mount the fasteners 25 and opposing spring sets 30, 32.

Secured to the bottom surface of the upper spring support members 20, 22 is cross member 35. Cross member 35 extends across the frame 10 and includes ends 36,37 that are secured to the opposing upper spring support members 20, 22. Cross member 35 is configured to be mounted across opposing sides of the frame 10 and provide a surface for the movement member 50 to bias thereagainst as will be further discussed herein. It is contemplated within the scope of the present invention that the cross member 35 could be manufactured from a metal plate or a metal square tube wherein the construction thereof would be selected based on the requirements of the movement member 50 and a desired configuration for engagement of the upper spring support members 20, 22 or an alternate portion of the frame 10. The cross member 35 is immovable so as to provide leverage thereagainst and movement of the lower spring support members 60,62 upon activation of the movement member 50.

The road grading blade teeth removal apparatus 100 includes a pair of lower spring support members 60, 62. The lower spring support members 60, 62 are mounted on opposing sides of the frame 10 and on the outside thereof. The lower spring support members 60, 62 are manufactured from a suitable rigid material such as but not limited to metal flat bar. The lower spring support members 60, 62 include fasteners 65 secured to opposing end 67,68. The fasteners 65 are configured to secure to opposing spring sets 30, 32. It should be understood that the opposing spring sets 30, 32 consist of four metal springs wherein two springs are on one side of the frame 10 and two springs are on the opposing side of the frame 10. Each opposedly located spring sets 30, 32 are secured to a lower spring support member 60, 62 utilizing fasteners 65. Mounted intermediate the lower spring support members 60,62 is center force plate 70. The center force plate 70 is a flat metal plate and is configured to have the movement member 50 superposed thereon. The assembly of the center force plate 70 and the lower spring support members 60,62 are suspendedly secured to the upper spring support members 20,22 utilizing opposing spring sets 30,32. The aforementioned movable mounting of the assembly of the center force plate 70 and the lower spring support members 60,62 facilitates the downward movement thereof upon engagement of the movement member 50 in order to facilitate the removal of teeth from the teeth receptacles 99 of the road grader blade 98.

The center force plate 70 has a pin mounting plate 72 secured to the top surface thereof. More specifically, the pin mounting plate 72 is superposed the center force plate 70, which has a hole therein allowing the pin 75 to extend through and downward therefrom. This configuration facilitates the ability to change the pin mounting plate 72 and pin 75 if needed. The pin mounting plate 72 is a flat metal plate that is releasably secured to the upper surface intermediate the upper surface of the center force plate and movement member 50 so as to provide maintenance of the position thereof. A pin 75 is secured to the pin mounting plate 72 and extends downward therefrom. The pin 75 is manufactured from a metal rod and is of sufficient diameter to engage the teeth receptacles 99 and be journaled therethrough so as to facilitate removal of teeth therefrom. The pin 75 is manufactured in a suitable length so as to be able to extend downwards to the road grader blade 98 subsequent the movement member 50 being moved to its second position wherein the movement member 50 has a portion thereof biased against the cross member 35 and has initiated downward movement of the assembly of the center force plate 70 and the lower spring support members 60,62 and as such the pin 75. While a pin mounting plate 72 has been disclosed herein, it is contemplated within the scope of the present invention that the pin 75 could be secured directly to the center force plate 70.

The lower portion 8 of the frame 10 includes a pin stabilization assembly 80 that is configured to provide the necessary support for the pin 75. As the pin 75 is moved downwards upon the movement member 50 being biased against the cross member 50, the pin stabilization assembly 80 functions to inhibit any lateral movement of the pin 75 so as to minimize the probability of damage to the pin 75. The pin stabilization assembly 80 includes central support members 81 and opposing lateral support members 82,83. The central support members 81 are cylindrical in shape having a hollow passage(not illustrated herein) so as to allow the pin 75 to be journaled therethrough and movable therewithin. The lateral support member 82 is triangular in shape and is configured to provide structural support for the central support members 81 so as to inhibit movement thereof. The lateral support member 83 is formed similarly to the lateral support member 82 but is on the opposing side of the frame 10. The combination of the lateral support members 82,83 provide the structural rigidity of the central support members 81 necessary so as to ensure the pin 75 will remain aligned with the teeth receptacle 99. It is contemplated within the scope of the present invention that the lateral support members 82,83 could be manufactured in numerous alternate manners so as to achieve the desired objective herein. While the pin stabilization assembly 80 has a preferred embodiment illustrated herein, it is contemplated within the scope of the present invention that the pin stabilization assembly 80 could be constructed in alternative manners and still achieve the desired objective stated herein.

The lower portion 8 of the frame 10 further includes a blade receiving assembly 90 that is positioned beneath the pin stabilization assembly 80. The blade receiving assembly 90 is configured to have superposed thereon a portion of the road grader blade 98 wherein the blade receiving assembly 90 is configured to position the road grader blade 98 such that the teeth receptacles 99 will align with pin 75. The blade receiving assembly 90 functions to ensure that the teeth receptacles 99 are axially aligned with the pin 75 so as to allow the pin 75 to be substantially journaled therein. The blade receiving assembly 90 includes horizontal support members 91,92 and angular support members 93,94. The horizontal support members 91,92 include a void therebetween so as to allow a tooth being extracted from the road grader blade 98 to fall therebetween. Further, the space between the base plates 14, 16 allows for a tooth to egress therepast as well. The horizontal support members 91,92 and angular support members 93,94 function to receive and support the road grader blade 98 in a position, as shown herein in FIG. 1, that places the teeth receptacles 99 in a position so as to be axially aligned with the pin 75.

The horizontal support members 91,92 further includes securing blocks 95,96 that are operable to provide support for the road grader blade 98 such that the teeth receptacles 99 are under pin 75 in a perpendicular angle of ninety degrees. The horizontal support members 91,92 and angular support members 93,94 are manufactured from suitable rigid materials such as but not limited to metal plate and it is contemplated within the scope of the present invention that the horizontal support members 91,92 and angular support members 93,94 could be formed from one piece of metal as opposed to separate members mounted intermediate opposing sides of the frame 10 to the four corner posts 12. It should also be understood within the scope of the present invention that the angle of the angular support members 93,94 could vary so as to provide the desired alignment of the road grader blade 98.

As previously described herein, the movement member 50 is superposed the center force plate 70 and biased against the cross member 35. In a preferred embodiment of the present invention the movement member 50 is a hydraulic jack. As the hydraulic jack is engaged so as to drive piston 51 upwards, the cross member 35 functions to bias thereagainst and as such move the center force plate 70 downwards as the center force plate 70 is suspendedly mounted utilizing opposing springs sets 30, 32. As the piston 51 of the hydraulic jack is continually moved upward, the resulting motion of the movement member 50 is downward and as such will distribute the force to the pin 75 that is being journaled into the teeth receptacle 99. This transfer of force provides the necessary pressure to remove teeth from the teeth receptacle 99 that may have been unable to have been removed by conventional hand tools due to debris and wear. While a hydraulic jack has been disclosed herein as being a preferred movement member 50, it is contemplated within the scope of the present invention that the movement member 50 could be constructed utilizing alternate embodiments in order to achieve the desired objective described herein.

The frame 10 further includes a blade support arm 97 secured thereto. The blade support arm 97 is manufactured from a durable rigid material such as but not limited to metal bar and is configured to have one end secured to the frame 10 and the opposing end secured to the road grader blade 98. The blade support arm 97 ensures the position of the road grader blade 98 will remain stationary as the road grading blade teeth removal apparatus 100 is utilized to remove teeth from the teeth receptacles 99. It is contemplated within the scope of the present invention that the blade support arm 97 could be manufactured in alternate lengths. It is further contemplated within the scope of the present invention that the support arm 97 can be adjustable different heights of the frame 10 or road grader blade 98.

While the road grading blade teeth removal apparatus 100 has been illustrated and discussed herein in a preferred embodiment, it is contemplated within the scope of the present invention that the road grading blade teeth removal apparatus 100 could employ alternate elements and/or construction in order to achieve the desired objective herein. More specifically but not by way of limitation, the opposing spring sets 30,32 could be replaced with alternate elements wherein the elements permit the movement of the center force plate 70 so as to traverse pin 75 in a downwards direction. In place of a suspended mounting of the lower spring support members 60,62 elements could be employed either in place of or in conjunction with the opposing spring sets 30,32 to facilitate the desired movable mounting of the center force plate 70.

In the preceding detailed description, reference has been made to the accompanying drawings that form a part hereof, and in which are shown by way of illustration specific embodiments in which the invention may be practiced.

These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An apparatus operable to remove teeth from a road grader blade comprising:

a frame, said frame having an upper end and a lower end, said frame having a plurality of support members;

a cross member, said cross member being secured to said frame proximate said upper end thereof, said cross member configured to extend intermediate opposing sides of said frame;

a center force plate, said center force plate being movably mounted to said frame, said center force plate configured to traverse in an upwards-downwards direction;

a pin, said pin extending downward from said lower mounting plate, said pin operable to move in conjunction with said center force plate;

a movement member, said movement member superposed said center force plate, said movement member having a portion operable to bias against said cross member, said movement member operable to traverse the center force plate in an upwards-downwards direction; and wherein the road grader blade is positioned underneath said pin so as to facilitate removal of teeth therefrom.

2. The apparatus operable to remove teeth from a road grader blade as recited in claim 1, and further including a blade receiving assembly, said blade receiving assembly being secured proximate the lower end of said frame, said blade receiving assembly configured to retain the road grader blade in a desired position for removal of teeth therefrom by said pin.

3. The apparatus operable to remove teeth from a road grader blade as recited in claim 2, and further including a pin stabilization assembly, said pin stabilization assembly mounted to said frame beneath said center force plate, said pin stabilization assembly operable to inhibit lateral movement of said pin.

4. The apparatus operable to remove teeth from a road grader blade as recited in claim 3, and further including opposing spring sets, said opposing spring sets being mounted on opposing sides of said frame, said opposing spring sets configured to provide movable mounting of said center force plate.

5. The apparatus operable to remove teeth from a road grader blade as recited in claim 4, and further including lower spring support members, said lower spring support members being present on opposing sides of said frame and operably coupled with said opposing spring sets.

6. The apparatus operable to remove teeth from a road grader blade as recited in claim 5, and further including a blade support arm, said blade support arm having a first end and a second end, said first end of said blade support arm being operably coupled to said frame, said second end of said blade support arm being configured to be secured to the road grader blade.

7. The apparatus operable to remove teeth from a road grader blade as recited in claim 6, wherein the movement member is a hydraulic jack.

8. A teeth removal apparatus for road grader blades comprising:

a frame, said frame having an upper end and a lower end, said from frame having four corner support members, said frame having opposing sides;

a pair of upper spring support members, said upper spring support members being secured to said upper end of said frame;

a pair of lower spring support members, said lower spring support members being movably secured to said upper spring support members and further being underneath thereto;

a cross member, said cross member being secured to said frame proximate said upper end thereof, said cross member configured to extend intermediate opposing sides of said frame;

a center force plate, said center force plate being mounted intermediate said pair of lower spring support members, said center force plate having an upper surface and a lower surface, said center force plate configured to traverse in an upwards-downwards direction;

a pin, said pin extending downward from said center force plate, said pin operable to move in conjunction with said lower mounting plate;

a movement member, said movement member superposed said upper surface of said center force plate, said movement member having a portion operable to bias against said cross member, said movement member operable to traverse the center force plate in an upwards-downwards direction; and wherein a road grader blade is positioned underneath said pin so as to facilitate removal of teeth therefrom.

9. The teeth removal apparatus for road grader blades as recited in claim 8, and further including a pin stabilization assembly, said pin stabilization assembly including a central support member being cylindrical in shape and having a hollow passage therethrough so as to have said pin movable therein.

10. The teeth removal apparatus for road grader blades as recited in claim 9, and further including a first spring set, said first spring set configured to movably couple said upper spring support members with said lower spring support members on a first side of the frame.

11. The teeth removal apparatus for road grader blades as recited in claim 10, and further including a second spring set, said second spring set configured to movably couple said upper spring support members with said lower spring support members on a second side of the frame.

12. The teeth removal apparatus for road grader blades as recited in claim 11, and further including a blade receiving assembly, said blade receiving assembly including a horizontal support member and an angular support member, said blade receiving assembly proximate said lower end of said frame, said blade receiving assembly configured to have a portion of the road grader blade superposed thereon.

13. The teeth removal apparatus for road grader blades as recited in claim 12, and further including a blade support arm, said blade support arm having a first end and a second end, said first end of said blade support arm being operably coupled to said frame, said second end of said blade support arm being configured to be secured to the road grader blade.

14. The teeth removal apparatus for road grader blades as recited in claim 13, wherein the movement member is a hydraulic jack.

15. An apparatus operable to assist in the removal of teeth from a road grader blade wherein the apparatus comprises:

a frame, said frame having an upper end and a lower end, said frame having four corner support members, said frame having opposing sides;

a pair of upper spring support members, said upper spring support members being secured to said upper end of said frame;

a pair of lower spring support members, said lower spring support members being movably secured to said upper spring support members and further being underneath thereto;

a first spring set, said first spring set configured to movably couple said upper spring support members with said lower spring support members on a first side of the frame;

a second spring set, said second spring set configured to movably couple said upper spring support members with said lower spring support members on a second side of the frame; wherein the first spring set and the second spring set are configured to suspendedly secure the pair of lower spring support members to the pair of upper spring support members;

a cross member, said cross member being secured to said frame proximate said upper end thereof, said cross member configured to extend intermediate opposing sides of said frame;

a center force plate, said center force plate being mounted intermediate said pair of lower spring support members, said center force plate having an upper surface and a lower surface, said center force plate configured to traverse in an upwards-downwards direction;

a pin, said pin extending downward from said lower mounting plate, said pin operable to move in conjunction with said lower mounting plate;

a movement member, said movement member superposed said upper surface of said center force plate, said movement member having a portion operable to bias against said cross member, said movement member operable to traverse the center force plate in an upwards-downwards direction; and wherein the road grader blade is positioned underneath said pin so as to facilitate removal of teeth therefrom.

16. The apparatus operable to assist in the removal of teeth from a road grader blade as recited in claim 15, and further including a blade receiving assembly, said blade receiving assembly including a horizontal support member and an angular support member, said blade receiving assembly proximate said lower end of said frame, said blade receiving assembly configured to have a portion of the road grader blade superposed thereon.

17. The apparatus operable to assist in the removal of teeth from a road grader blade as recited in claim 16, and further including a pin stabilization assembly, said pin stabilization assembly including a central support member being cylindrical in shape and having a hollow passage therethrough so as to have said pin movable therein, said central support member having opposing lateral support members secured thereto and wherein said lateral support members are secured to opposing sides of said frame.

18. The apparatus operable to assist in the removal of teeth from a road grader blade as recited in claim 17, and further including a blade support arm, said blade support arm having a first end and a second end, said first end of said blade support arm being operably coupled to said frame, said second end of said blade support arm being configured to be secured to the road grader blade.

19. The apparatus operable to assist in the removal of teeth from a road grader blade as recited in claim 18, and further including a pair of base plates, said pair of base plates being secured to the lower end of said frame.

20. The apparatus operable to assist in the removal of teeth from a road grader blade as recited in claim 19, wherein the movement member is a hydraulic jack.

* * * * *